US005752228A

United States Patent [19]

Yumura et al.

[11] Patent Number: 5,752,228

[45] Date of Patent: May 12, 1998

[54] SPEECH SYNTHESIS APPARATUS AND READ OUT TIME CALCULATING APPARATUS TO FINISH READING OUT TEXT

[75] Inventors: Takeshi Yumura, Neyagawa; Hiroki Ohnishi; Masanori Miyatake, both of Hirakata; Naoyuki Yoden, Toyonaka; Masashi Ochiiwa, Ogaki; Takashi Izumi, Gifu, all of Japan

[73] Assignee: Sanyo Electric Co., Ltd., Osaka, Japan

[21] Appl. No.: 564,594

[22] Filed: Nov. 29, 1995

[30] Foreign Application Priority Data

May 31, 1995 [JP] Japan ..... 7-133374

[51] Int. Cl.[6] ..... G10L 9/00

[52] U.S. Cl. ..... 704/260; 704/231; 704/235; 704/251

[58] Field of Search ..... 395/2.69; 704/231, 704/235, 251, 257, 260

[56] References Cited

U.S. PATENT DOCUMENTS

| | | | |
|---|---|---|---|
| 4,527,274 | 7/1985 | Gaynor | 395/2.76 |
| 4,692,941 | 9/1987 | Jacks et al. | 395/2.69 |
| 4,799,261 | 1/1989 | Lin et al. | 395/2.38 |
| 4,833,718 | 5/1989 | Sprague | 395/2.38 |
| 4,852,168 | 7/1989 | Sprague | 395/2.2 |
| 5,155,728 | 10/1992 | Takeuchi et al. | 370/100.1 |
| 5,396,577 | 3/1995 | Oikawa et al. | 395/2.69 |
| 5,555,343 | 9/1996 | Luther | 395/269 |
| 5,615,301 | 3/1997 | Rivers | 395/2.86 |

*Primary Examiner*—Allen R. MacDonald
*Assistant Examiner*—Alphonso A. Collins
*Attorney, Agent, or Firm*—Armstrong, Westerman, Hattori, McLeland, & Naughton

[57] ABSTRACT

A speech synthesis apparatus for synthesizing speech to read out a text in place of a reader at a speed corresponding to a set time and the text volume, a medium on which is recorded a computer program for reading out a text in place of a reader, an apparatus for calculating time necessary for a reader to finish reading out a text on the basis of the reader's speech characteristic data of a prescribed word or sentence, and a medium on which is recorded a computer program for calculating the read out time.

12 Claims, 12 Drawing Sheets

SPEECH SYNTHESIS APPARATUS AND READ OUT TIME CALCULATING APPARATUS TO FINISH READING OUT TEXT

BACKGROUND OF THE INVENTION

1. Field of the Invention

The present invention relates to a speech synthesis apparatus for synthesizing speech on the basis of the text data at a speed that can finish reading out a text within a fixed time, and a medium on which is recorded a computer program for reading out text instead of a reader. Further, the present invention relates to a read out time calculating apparatus for calculating time necessary for a reader to finish reading out a text, according to a speaking speed extracted from the reader's speech data, and a medium on which is recorded a computer program for calculating the time to finish reading out the text.

2. Description of the Related Art

The time permitted to read out a manuscript or to narrate is limited within an announcement time prepared for each speaker in a lecture, speech or the like, within the time a title is displayed on a screen, within a prelude or interlude being played, or within the time a picture relating to the contents of a story is displayed on the screen. Further, when reading out a text data through a charged media, a charge depends on the time for reading out the text.

In the case where the time to read out a text is an important factor as above, a reader of a manuscript, in general, reads out the manuscript in the same tone and emotion as an actual reading. Afterwards, the reader deletes some contents of the manuscript, or summarizes the manuscript when the time to finish reading out is over the permitted time, but supplements the contents of the text when the time to finish reading out is shorter than the permitted time. By repeating such trial and error, the reader is able to finish reading out the manuscript within the fixed time.

If the contents of the manuscript cannot be be deleted, the reader speeds up the read out speed but ensures that it remains communicable enough by repeating through trial and error in order to finish reading out within the fixed time.

As a result, the reader necessarily bears a burden for reading out the manuscript again and again to complete the manuscript, or adjusting the read out speed, whereby the burden on the reader becomes heavier as the manuscript gets longer. Further, since the way, speed or tone to read out the manuscript varies from person to person, the time to read out a manuscript is not always identical between the reader of the manuscript and other persons. Thus, it is impossible for the other persons to take the place of the reader.

SUMMARY OF THE INVENTION

The present invention is devised to overcome the aforementioned problems. It is an object of the invention to provide a speech synthesis apparatus and a medium on which is recorded a computer program for reading out a text in place of a reader where the synthesized speech at such a speed that can finish reading out the text takes the place of the reader, thereby lightening the burden of completing the text which is able to finish reading out within a fixed time.

Another object of the invention is to provide a speech synthesis apparatus and a medium on which is recorded a computer program for reading out a text in place of a reader where the synthesized speech is extremely like speech by the reader thereby lightening the burden of completing the text by the reader within a fixed time.

A further object of the invention is to provide a speech synthesis apparatus and a medium on which is recorded a computer program for reading out a text in place of a reader where the smooth and natural synthesized speech takes the place of the reader's speech, thereby lightening the burden of completing the text by the reader within a fixed time.

Yet another object of the invention is to provide a read out time calculating apparatus and a medium on which is recorded a computer program for calculating the time to finish reading out the text without actually reading out the text, thereby lightening the burden of the reader in completing the text.

A speech synthesis apparatus or a medium of the invention, on which is recorded a computer program for reading out a text in place of a reader, calculates time to read out the text at a prescribed read out speed when the fixed time to read out the text is set, determines the read out speed which makes the calculated time agree with the set time on the basis of the text data, then synthesizes speech at the determined read out speed. A user judges whether the read out speed which enables the text to be read out within the set time is appropriate for sufficiently transmitting the contents of the text on listening to the synthesized speech. When judging the contents being sufficiently transmitted, the user makes the prescribed reader read the text at the determined speed without changing the contents, but when judging the contents being insufficiently transmitted, the user adjusts the contents of the text. Consequently, it is unnecessary to actually read out the text for judging whether the reading speed is appropriate.

A speech synthesis apparatus or a medium of the invention, on which is recorded a computer program for reading out a text in place of a reader, synthesizes speech of a prescribed reader on the basis of the text data. Consequently, whether the text data is sufficiently transmitted when the reader reads out the text quickly or slowly becomes clear by storing speech characteristic data of the reader to read out the text, thereby to enable checking of individual obscurity caused by a speech characteristic of the reader.

A read out time calculating apparatus or a medium of the invention, on which is recorded a computer program for calculating time to read out a text, calculates the time to read out text data at a prescribed read out speed while calculating a relative value of the reading speed of the reader to the prescribed read out speed for adjusting the read out time at the prescribed speed, thereby to calculate and output the time necessary for the reader to read out the text. A user deletes or supplements the contents of the text on referring to the output time so that time necessary for finishing to read out the text is nearly a prescribed time. Consequently, it is unnecessary for the reader to actually read out the text for calculating time to finish reading out the text.

A read out time calculating apparatus or a medium of the invention, on which is recorded a computer program for calculating time to finish reading out a text, calculates the time to finish reading out text data at a read out speed being set, then outputs the calculated time. A user deletes or supplements the contents of the text on referring to the output time so that the time necessary for finishing the read out the text is nearly at a prescribed time. Consequently, it is unnecessary for the reader to actually read out the text for calculating time to finish reading out the text.

The above and further objects and features of the invention will more fully be apparent from the following detailed description with the accompanying drawings.

DESCRIPTION OF THE PREFERRED EMBODIMENTS

Figure 1:
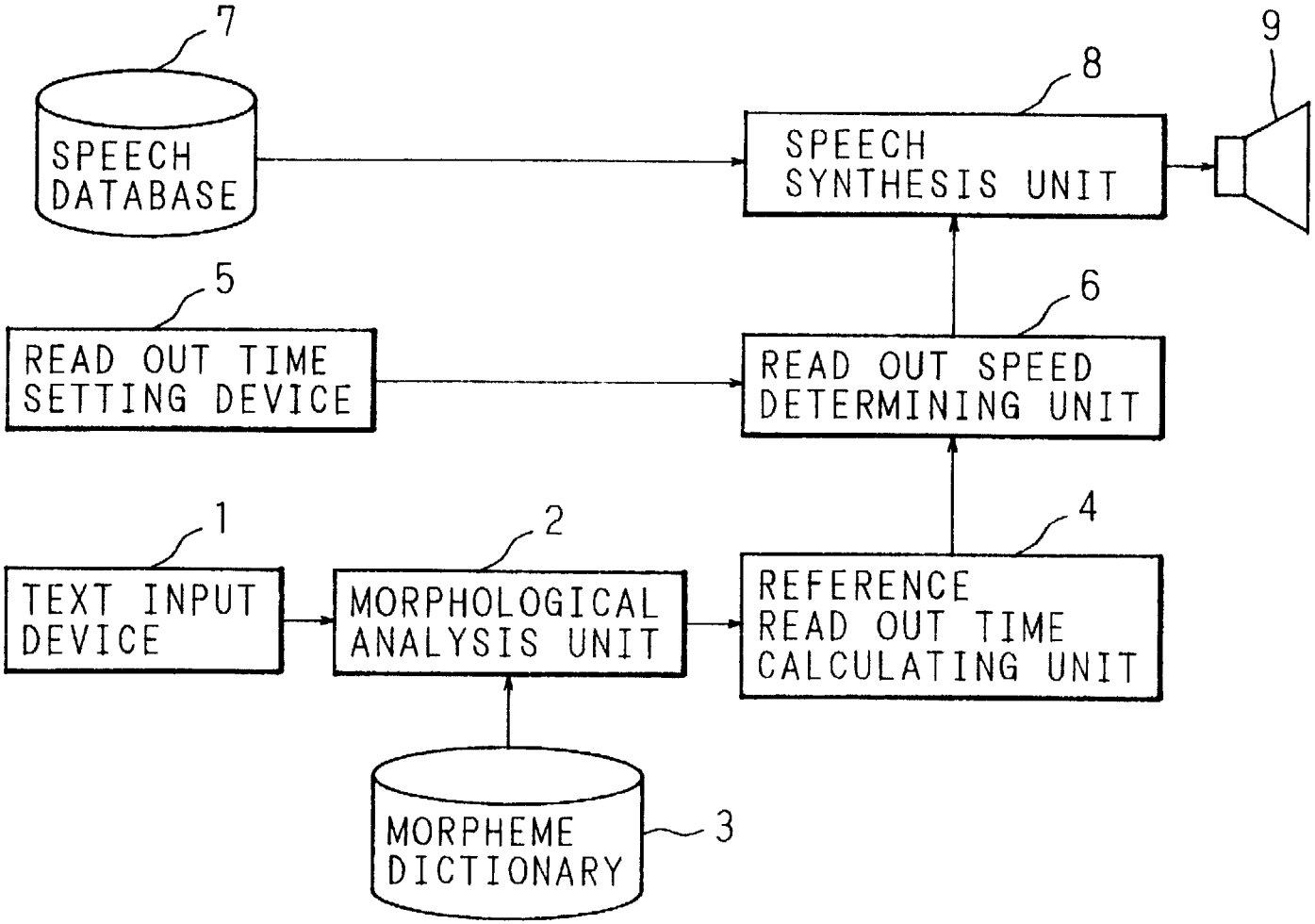
FIG. 1 is a block diagram showing an embodiment of a speech synthesis apparatus of the invention.

FIG. 1 is a block diagram of a speech synthesis apparatus of the invention. In the figure, numeral 1 designates a text input device such as a keyboard, scanner, touch panel or the like for inputting text data. A morphological analysis unit 2 cuts out the text data sentence by sentence, for example, input by the text input device 1 referring to a morpheme dictionary 3, then morphologically analyzes the sentence to attach a part of speech and accent data thereto. If the text data is Japanese, the morphological analysis unit 2 further attaches the Japanese equivalent "yomi" to the text data. The morphological analysis unit 2 extracts punctuation of a clause and accent phrases, and attaches pause data necessary to put a pause in reading. The morphological analysis unit 2 further performs a phonemic language processing on the text data to add focus data to a part necessary to be phonetically emphasized and to attach speed control data according to presence or absence of the focus data. A reference read out time calculating unit 4 changes the length of a mora (tactus) which is a time unit, corresponding to speaking time of a normal syllable, on a time scale of a speech waveform in order to read out the focused part of the text data slowly. Then, the reference read out time calculating unit 4 adds up the read out time of each sentence of the text at a reference read out speed having a reference read out speed parameter to calculate the reference read out time of the whole text.

A read out time setting device 5 is composed of a ten-key pad or the like for setting a time to finish reading out a text. A read out speed determining unit 6 determines a read out speed parameter which makes the reference read out time agree with the set read out time on comparing the read out time set by the read out time setting device 5 with the reference read out time calculated by the reference read out time calculating unit 4.

A speech database 7 stores unit waveform signals of the text data as data for the speech synthesis obtained by dividing the text data into units which are suitable for speaking for the speech synthesis but not into notational units, on the basis of the phonological analysis or the like, thereby enabling the text to be read out in a way as natural as possible. The speech database 7 further stores speech characteristic data of a reader preliminarily extracted from a frequency spectrum of speech data of the reader obtained by speaking a prescribed word, sentence or the like.

A speech synthesis unit 8 reads out the data for performing the speech synthesis for the text data, and the speech characteristic in order to perform a waveform signal processing for linking the data for the speech synthesis of every unit having the reader's speech characteristic, thereby enabling the text data to be smoothly read out. Then the speech synthesis unit 8 outputs the synthesized speech from a speaker 9 as if the reader is reading out the text.

Figure 2:
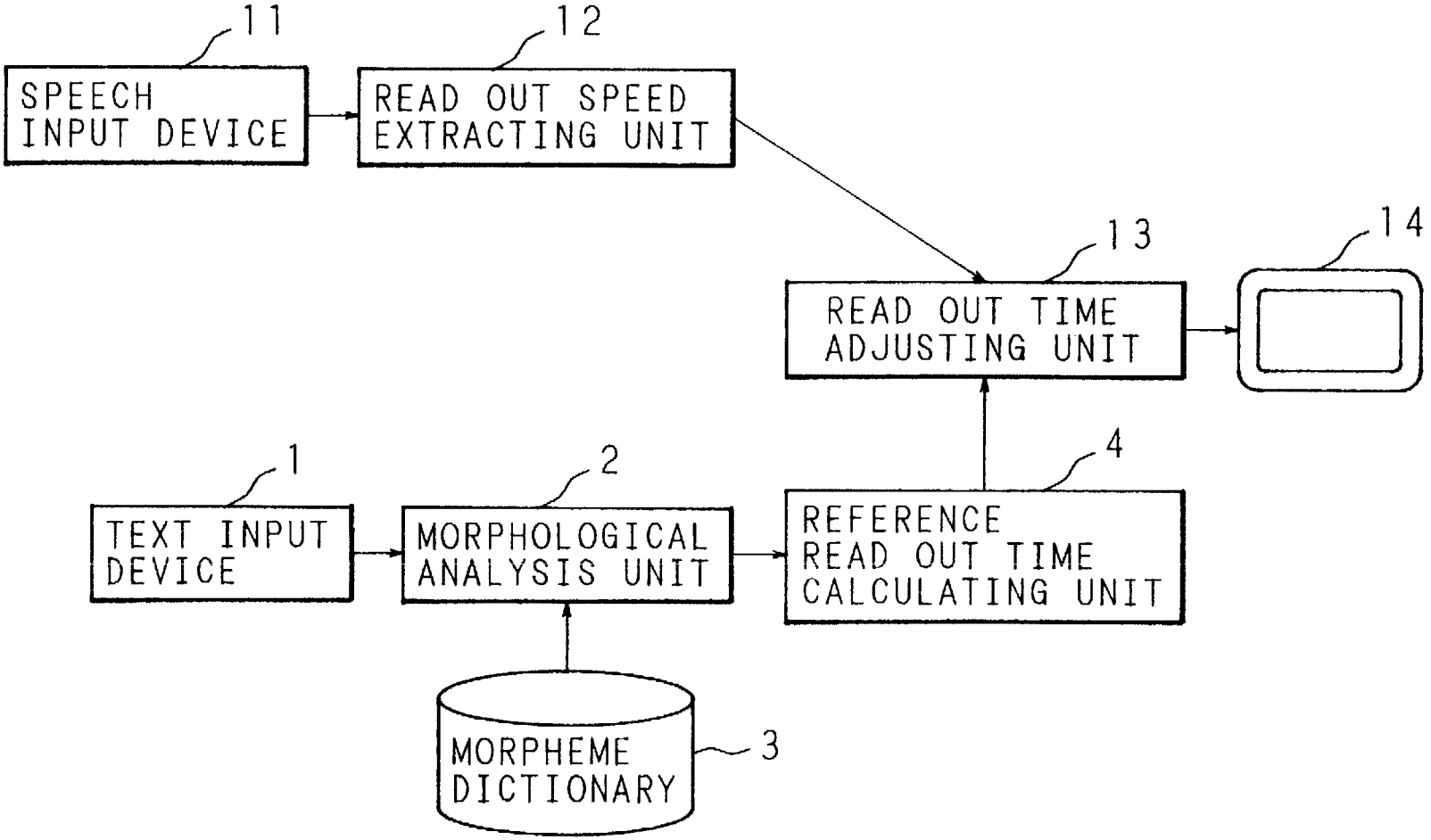
FIG. 2 is a block diagram showing an embodiment of a read out time calculating apparatus of the invention.

FIG. 2 is a block diagram showing an embodiment of a read out time calculating apparatus of the invention. In the figure, the same parts (1–4) as in the speech synthesis apparatus of FIG. 1 are denoted by the same numeral and their explanations will be omitted here.

In the figure, numeral 11 designates a speech input device 11 such as a microphone. A read out speed extracting unit 12, which stores speech data of a prescribed word, sentence or the like spoken at a reference speed, extracts a parameter of the read out speed of a reader relative to the reference read out speed on comparing the speech data of the prescribed word or sentence spoken by the reader and input through the speech input device 11 with the speech data at the reference read out speed.

A read out time adjusting unit 13 adjusts the reference read out time calculated by the reference read out time calculating unit 4 on the basis of the read out speed parameter extracted by the read out speed extracting unit 12 to calculate the read out time of the text by the reader. The read out time adjusting unit 13 displays the read out time of the reader on a monitor 14.

Figure 3:
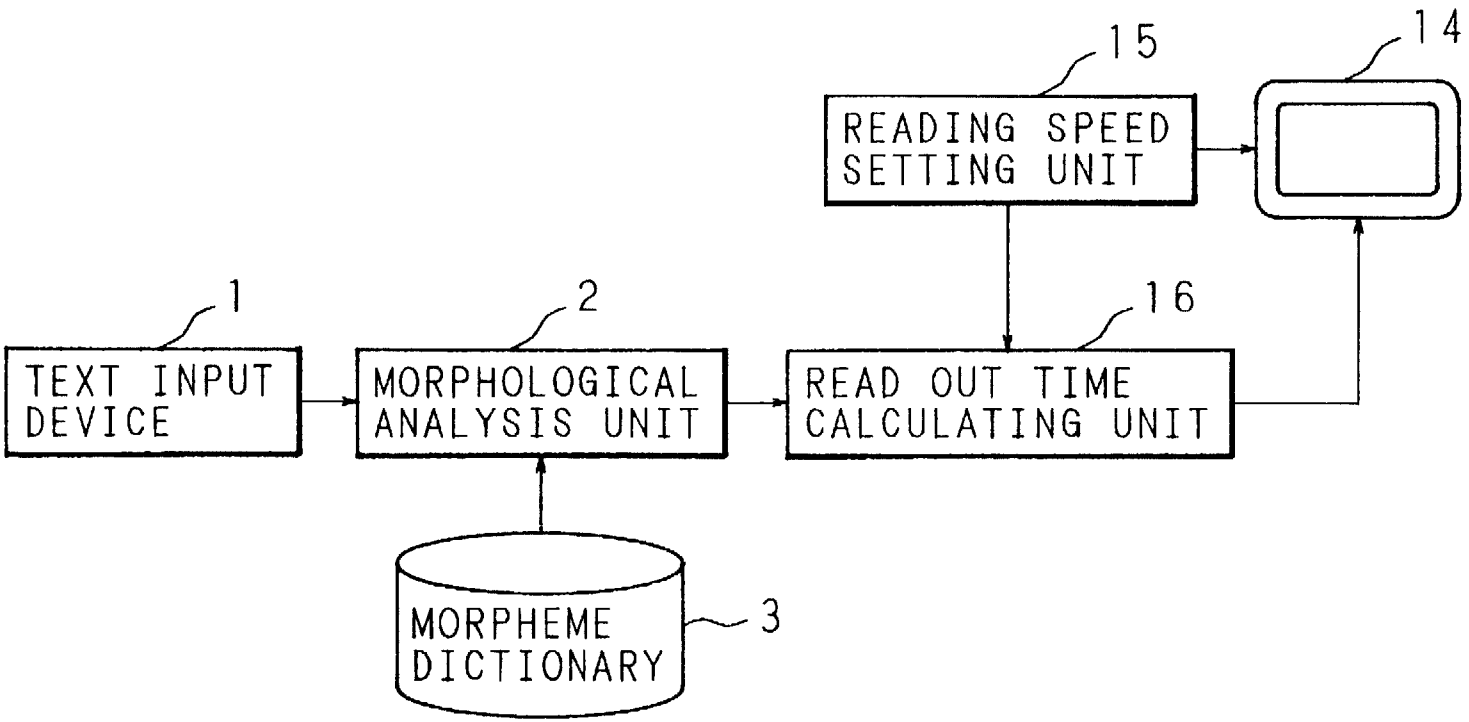
FIG. 3 is a block diagram showing a modified embodiment of a speech synthesis apparatus of the invention.

FIG. 3 is a block diagram showing a modified embodiment of a read out time calculating apparatus of the invention. In the figure, the same parts as in the speech synthesis apparatus of FIG. 1 or as in the read out time calculating apparatus of FIG. 2 are denoted by the same numeral and their explanations will be omitted here.

This modified embodiment differs from the abovementioned embodiment in setting the read out speed but not extracting that from the speech data input through the microphone. Therefore, the apparatus is provided with a read out speed setting device 15 and a read out time calculating unit 16. The read out time calculating unit 16 changes the length of a mora (tactus) which is a time unit, corresponding to speaking time of a normal syllable, on a time scale of a speech waveform in order to read out the focused part of the text data slowly. Then, the read out time calculating unit 16 adds up the read out time of each sentence of the text at the set read out speed up to calculate the read out time of the whole text.

Figure 4:
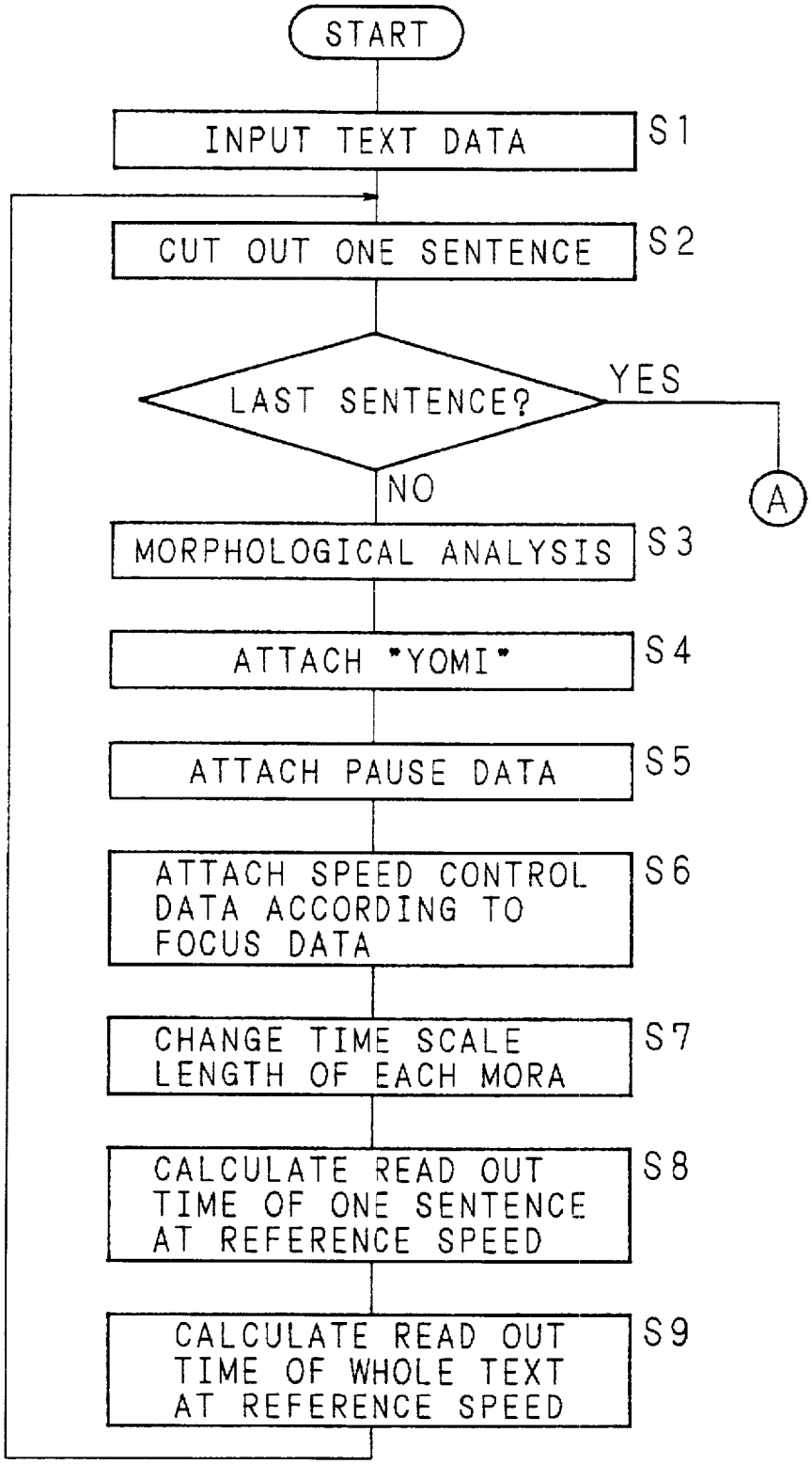
FIG. 4 is a flowchart showing a procedure for reading out a text by synthesized speech at a read out speed adjusted to the set time.
Figure 5:
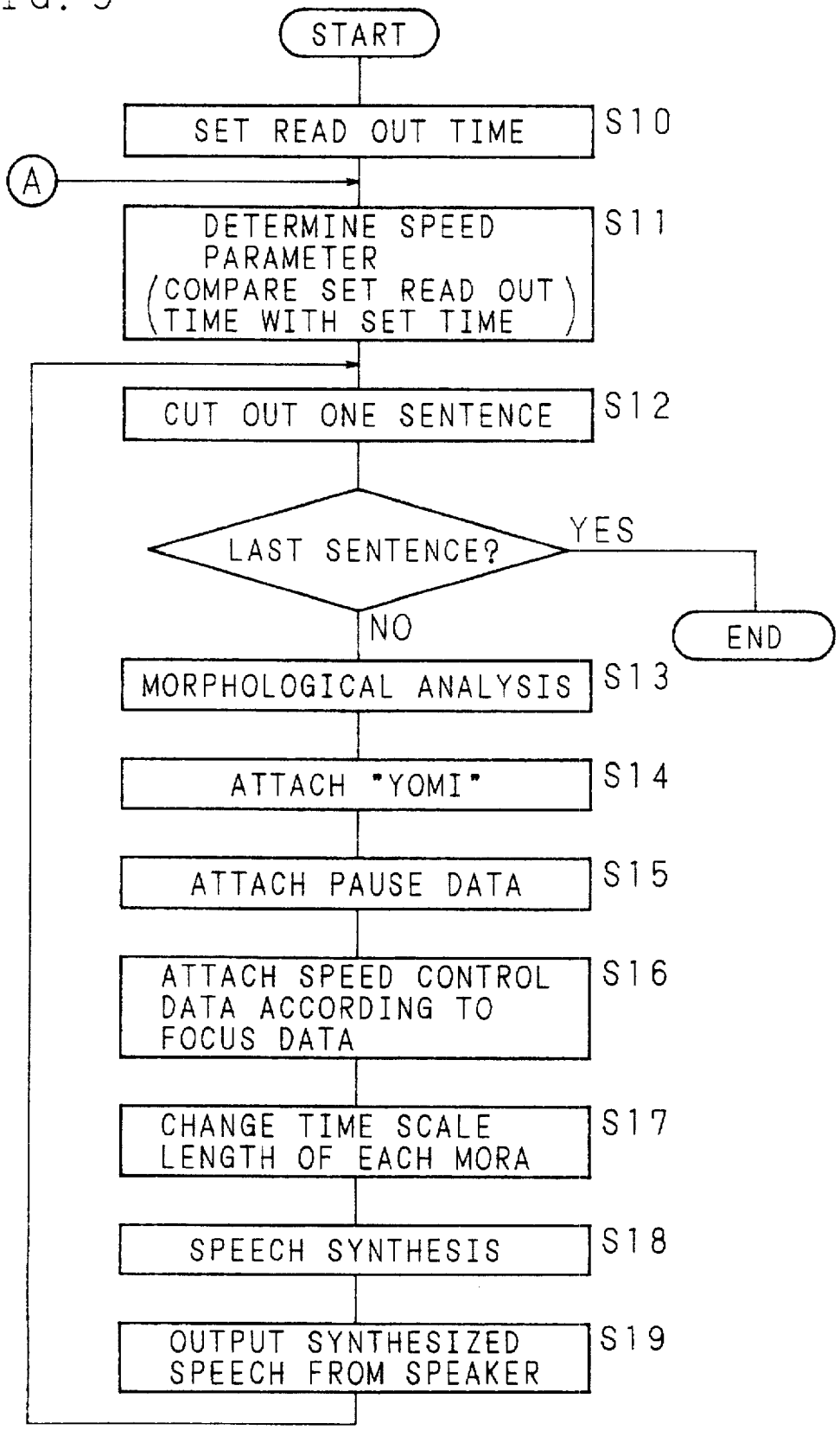
FIG. 5 is a flowchart showing a procedure for reading out a text by synthesized speech at a read out speed adjusted to the set time.

The procedure of reading out a Japanese text by the speech synthesis apparatus of the invention instead of a reader will be explained according to flowcharts in FIG. 4 and FIG. 5.

When text data is input through the text input device 1 (S1), the morphological analysis unit 2 cuts out one sentence from the input text data (S2). Then, the morphological analysis unit 2 analyzes the text data into morphemes to attach a part of speech and accent data to each morpheme referring to the morpheme dictionary 3 (S3). The morphological analysis unit 2 further attaches the "yomi" to each morpheme. The morphological analysis unit 2 extracts a clause, an accented phrase to attach pause data to a part necessary to put a pause in reading (S5).

Figure 6:
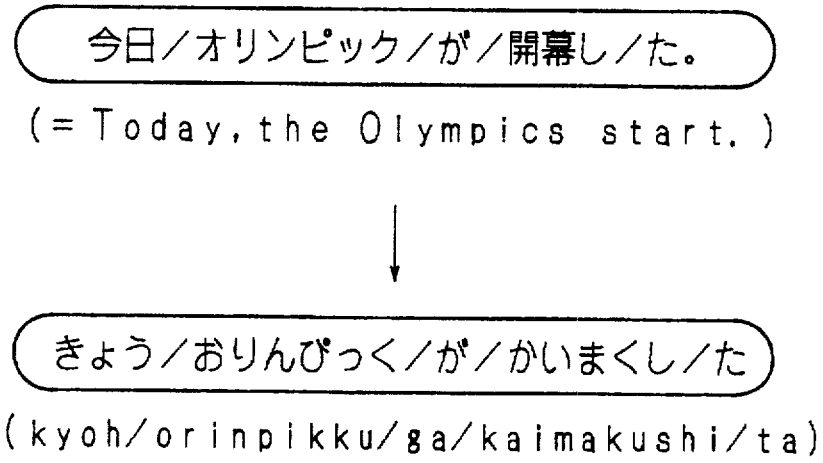
FIG. 6 is a conceptual diagram showing the state of Japanese text data to which is attached the Japanese equivalent ("yomi" in Japanese) as a result of the morphological analysis.

FIG. 6 is a conceptual diagram showing the state of the morphologically analyzed Japanese text data with the "yomi" being attached.

In the figure, a sentence "今日オリンピックが開幕した" (=Today, the Olympics start) is analyzed to morphemes "今日/ オリンピック/が/開幕し/た", then the "yomi" is attached to each morpheme "kyoh/ orinpikku/ ga/ kaimakushi/ ta".

Figure 7:
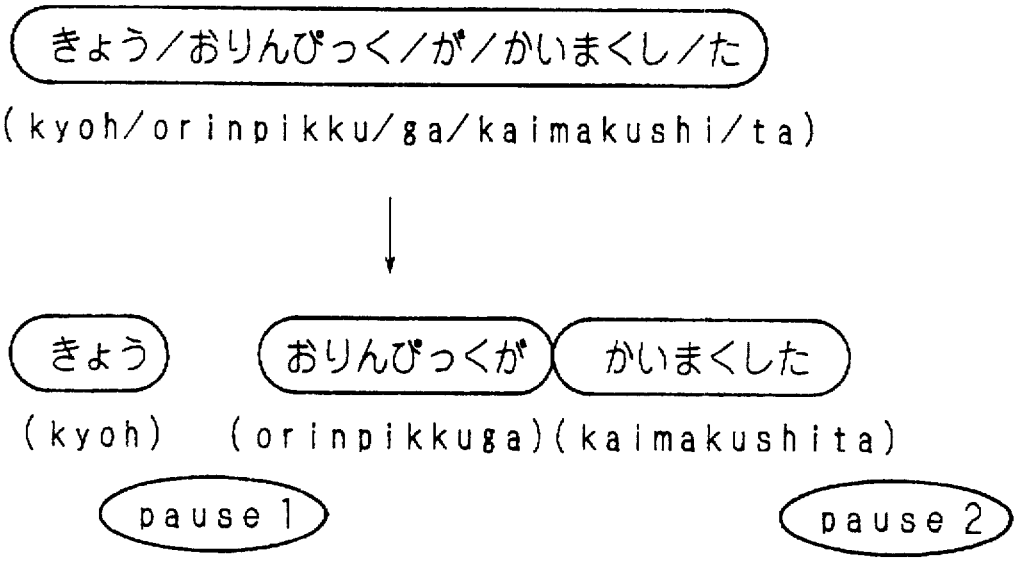
FIG. 7 is a conceptual diagram showing the state of the "yomi" attached Japanese text data with pause data as a result of the morphological analysis.

FIG. 7 is a conceptual diagram showing the state of the "yomi" attached text data to which further attached pause data.

As shown in the figure, pause data 1 is attached to the text data with the "yomi" being attached as in FIG. 6, between the yomi's "kyoh" and "orinpikkuga", and pause data 2 is attached after the yomi "kaimakushita".

The morphological analysis unit 2 performs a phonemic language processing on the text data to add focus data to a part necessary to be phonetically emphasized and to attach speed control data to read the focus data added part slowly according to a part with the focus data being attached (S6). The reference read out time calculating unit 4 changes the length of a mora so as to read out the focused part of the text data slowly (S7). Then, the reference read out time calculating unit 4 calculates reference read out time of one sentence at a reference read out speed (S8), and adds up the read out time of each sentence at the reference read out speed to calculate the reference read out time of the whole text (S9).

On the other hand, when time to finish reading out the text is set through the read out time setting device 5, the read out speed determining unit 6 determines a read out speed parameter which makes the reference read out time agree with the set read out time. In other words, the read out speed parameter which enables the text to be read within the set time is set, on comparing the read out time set by the read out time setting device 5 with the reference read out time calculated by the reference read out time calculating unit 4 (S11).

By performing the above-mentioned steps S2–S7, the "yomi", pause data, and speed control data depending on presence and absence of the focus data are attached to each mora of each sentence (S12–S16), and the length of each mora is changed (S17) on the basis of the calculated read out speed parameter as above. The speech synthesis unit 8 synthesizes speech at the read out speed which enables the text data to be read within the set time on the basis of the adjusted parameters according to the read out time parameter which enables the text data to be read within the set time and on the basis of the stored speech characteristic data of the reader in the speech database 7 (S18), and outputs the synthesized speech from the speaker 9 (S19). By repeating the above processing for every sentence, the synthesized speech of the whole text is output.

A user judges whether the read out speed which enables the text to be read out within the set time is appropriate for sufficiently transmitting the contents of the text on listening to the synthesized speech, reading out the text. When judging the contents being sufficiently transmitted, the reader reads the text at the determined speed without changing the contents, but when judging the contents being insufficiently transmitted, the user deletes or summarizes the contents of the text.

In this embodiment, the extracted speech characteristic data from the reader's speech data is stored in the speech database 7, but such configuration as to read out the text by the synthesized speech of the unspecified person without storing the reader's speech characteristic data may be applicable.

Figure 8:
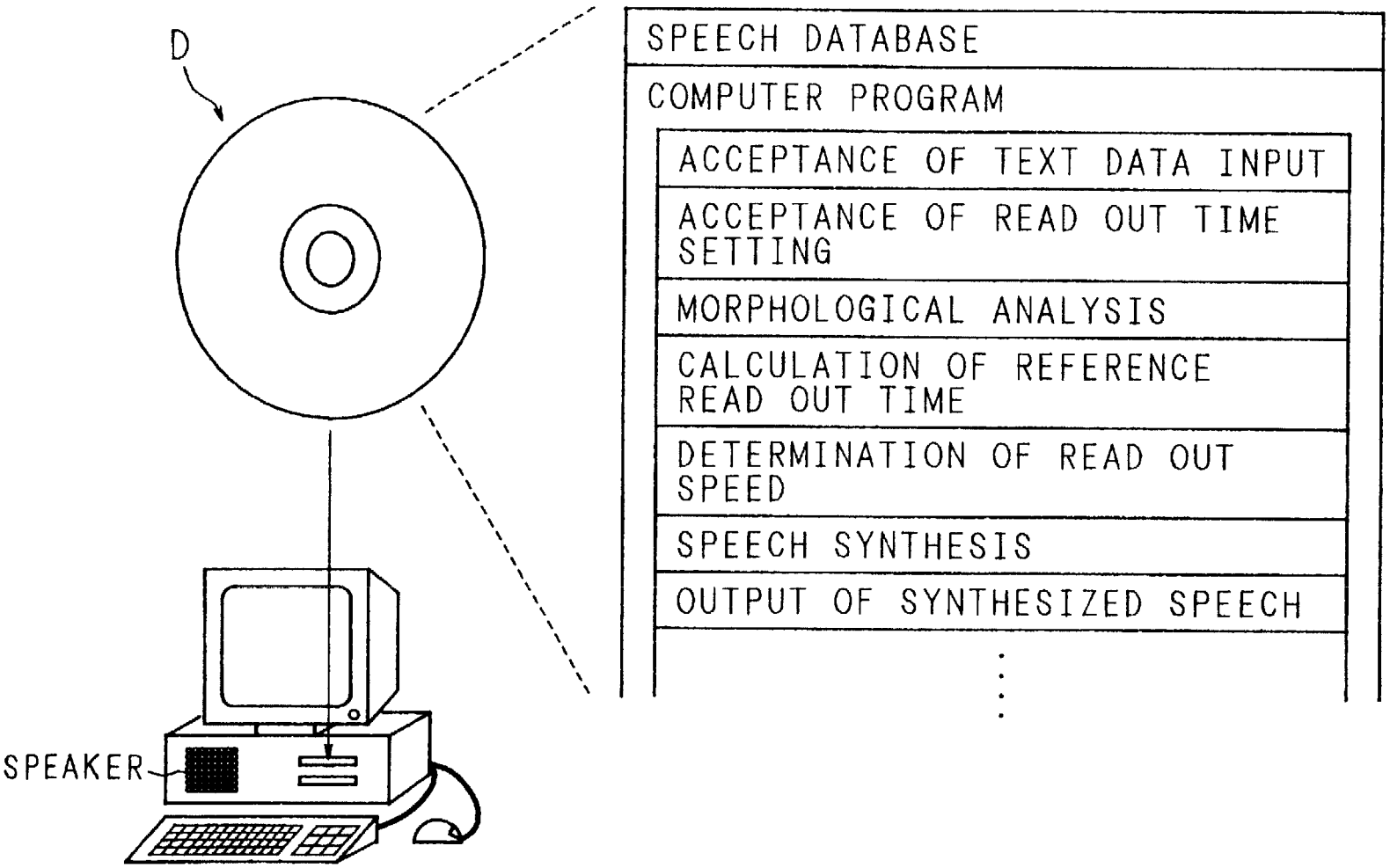
FIG. 8 is a conceptual diagram showing the recorded state of a medium of the invention on which is recorded a computer program for reading out a text in place of a reader.

Besides, a computer program of the above-mentioned procedure of reading out the text in place of the reader may not only be written in a ROM of the speech synthesis apparatus having the construction as shown in FIG. 1, but may be written in a recording medium D such as a compact disk as shown in FIG. 8. When loading such recording medium D in a disk drive of a personal computer, the personal computer becomes able to read out the text in place of the reader.

Figure 9:
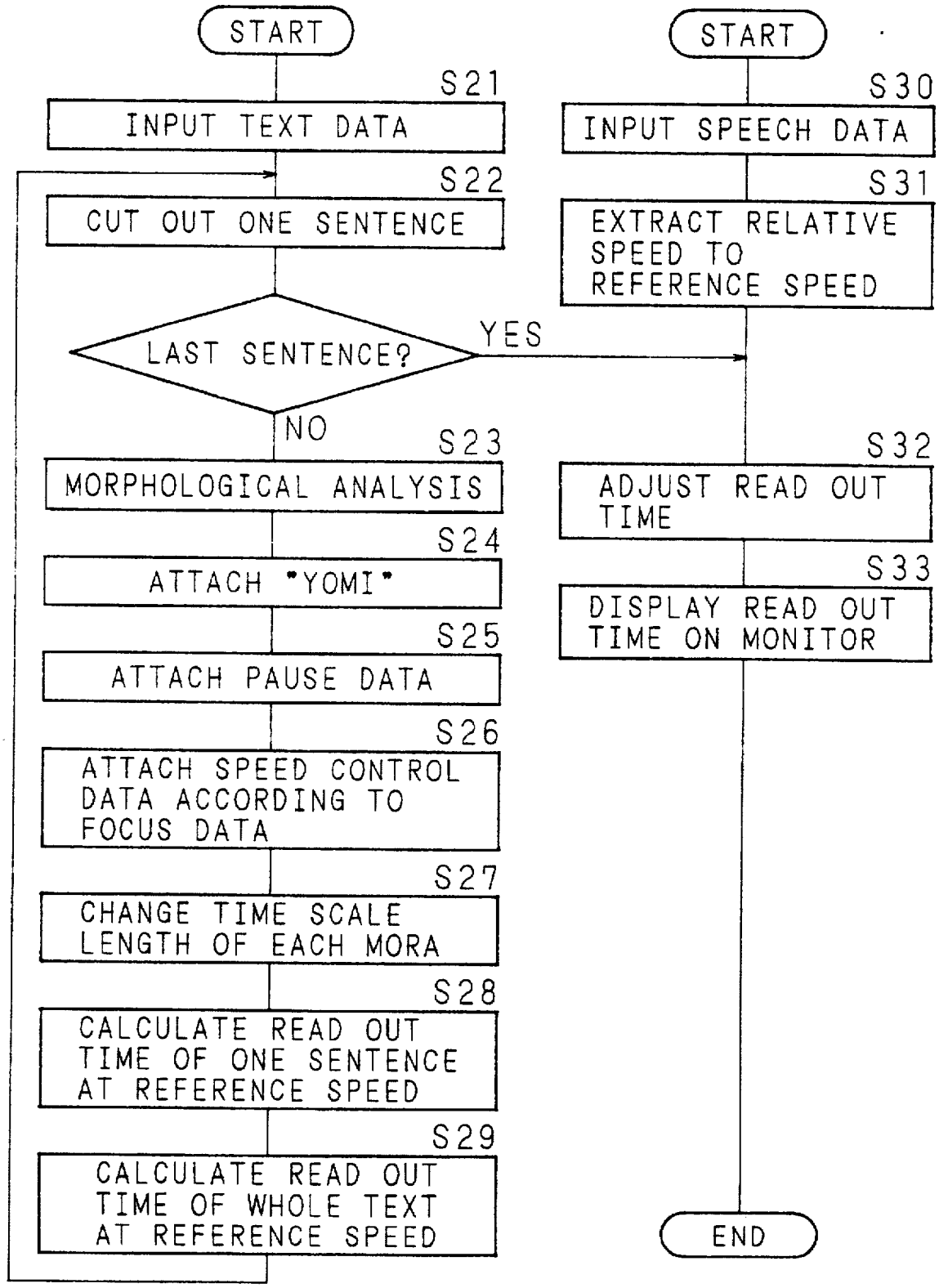
FIG. 9 is a flowchart showing a procedure for calculating a time to finish reading out a text by a read out time calculating apparatus of the invention.

The procedure of calculating the read out time by the read out time calculating apparatus of the invention will be explained according to a flowchart in FIG. 9.

When text data is input through the text input device 1 (S21), the morphological analysis unit 2 cuts out one sentence from the input text data (S22). Then, the morphological analysis unit 2 analyzes the text data into morphemes to attach a part of speech and accent data to each morpheme referring to the morpheme dictionary 3 (S23). The morphological analysis unit 2 further attaches the "yomi" to each morpheme (S24). The morphological analysis unit 2 extracts a clause, an accented phrase to attach pause data to a part necessary to put a pause in reading (S25).

The morphological analysis unit 2 performs a phonemic language processing on the text data to add focus data to a part necessary to be phonetically emphasized and to attach speed control data to read the focus data attached part slowly according to a part with the focus data being attached (S26). The reference read out time calculating unit 4 changes the length of a mora so as to read out the focused part of the text data slowly (S27). Then, the reference read out time calculating unit 4 calculates reference read out time of one sentence at a reference read out speed (S28), and adds up the read out time of each sentence at the reference read out speed to calculate the reference read out time of the whole text (S29).

On the other hand, when the reader's speech is input through the speech input device 11 (S30), the read out speed extracting unit 12 extracts a parameter of the read out speed of the reader relative to the reference read out speed on comparing the speech data of the prescribed word or sentence spoken by the reader and input through the speech input device 11 with the speech data at the reference read out speed (S31). The read out time adjusting unit 13 adjusts the reference read out time calculated by the reference read out time calculating unit 4 on the basis of the read out speed parameter extracted by the read out speed extracting unit 12 (S32) to calculate the read out time of the text by the reader. The read out time adjusting unit 13 displays the read out time of the reader on a monitor 14 (S33).

Figure 10:
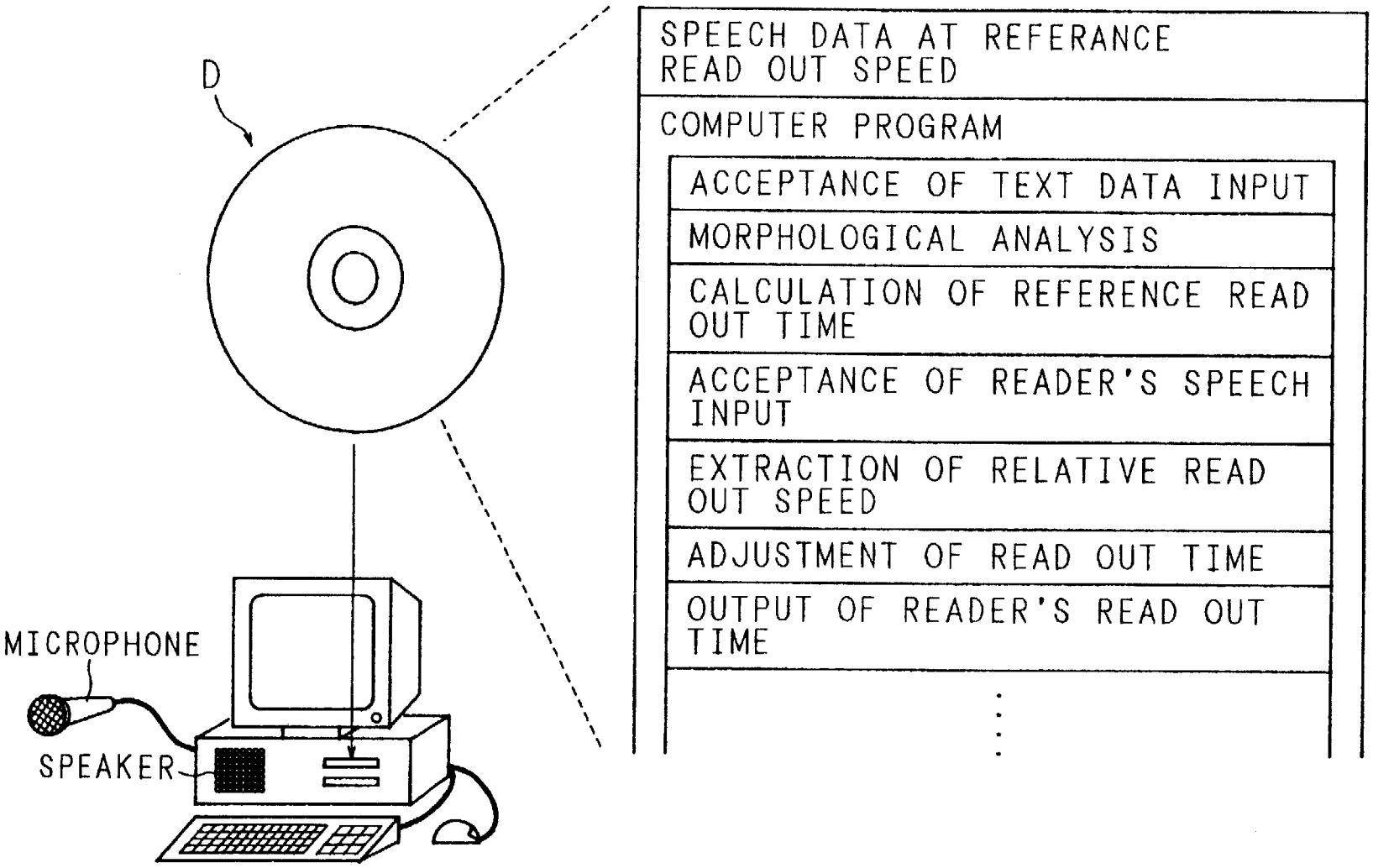
FIG. 10 is a conceptual diagram showing the recorded state of a medium of the invention on which is recorded a computer program involving the procedure of FIG. 9 to calculate the time to finish reading out a text.

A computer program of the above-mentioned procedure of calculating the read out time of the the text may not only be written in a ROM of the read out time calculating apparatus having the construction as shown in FIG. 2, but may be written in a recording medium D such as a compact disk as shown in FIG. 10. When loading such recording medium D in a disk drive of a personal computer, the personal computer becomes able to calculate the read out time of the text.

Figure 11:
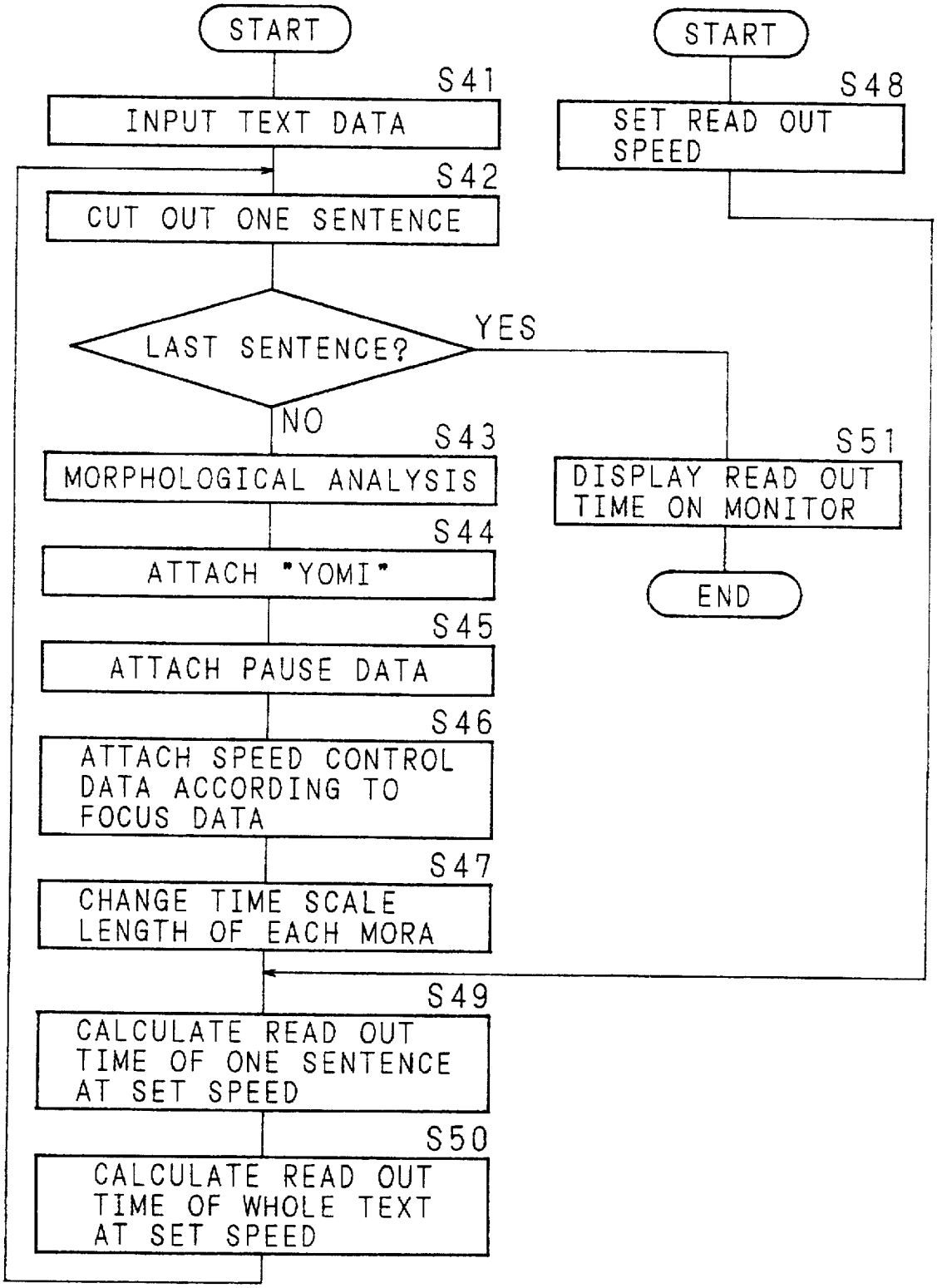
FIG. 11 is a flowchart showing a procedure for calculating a time to finish reading out a text by a modified embodiment of a read out time calculating apparatus of the invention.

FIG. 11 is a flowchart showing the procedure of calculating the read out time by the modified embodiment of the read out time calculating apparatus of the invention.

When text data is input through the text input device 1 (S41), the morphological analysis unit 2 cuts out one sentence from the input text data (S42). Then, the morphological analysis unit 2 analyzes the text data into morphemes to attach a part of speech and accent data to each morpheme referring to the morpheme dictionary 3 (S43). The morphological analysis unit 2 further attaches the "yomi" to each morpheme (S44). The morphological analysis unit 2 extracts a clause, an accented phrase to attach pause data to a part necessary to put a pause in reading (S45).

The morphological analysis unit 2 performs a phonemic language processing on the text data to add focus data to a part necessary to be phonetically emphasized and to attach speed control data to read the focus data added part slowly according to a part with the focus data being attached (S46). The read out time calculating unit 16 changes the length of a mora so as to read out the focused part of the text data slowly (S47).

On the other hand, when the read out speed is set through the read out speed setting device 15 (S48), the read out time calculating unit 16 calculates read out time of one sentence at the set read out speed (S49), and adds up the read out time of each sentence at the set read out speed up to calculate the read out time of the whole text (S50). The read out time calculating unit 16 displays the read out time of the reader on a monitor 14 (S51).

A user deletes the contents of the text or summarizes the contents when the read out time exceeds the allotted speech time, but supplements the contents when the read out time does not reach the allotted time on referring to the read out time output on the monitor 14.

Figure 12:
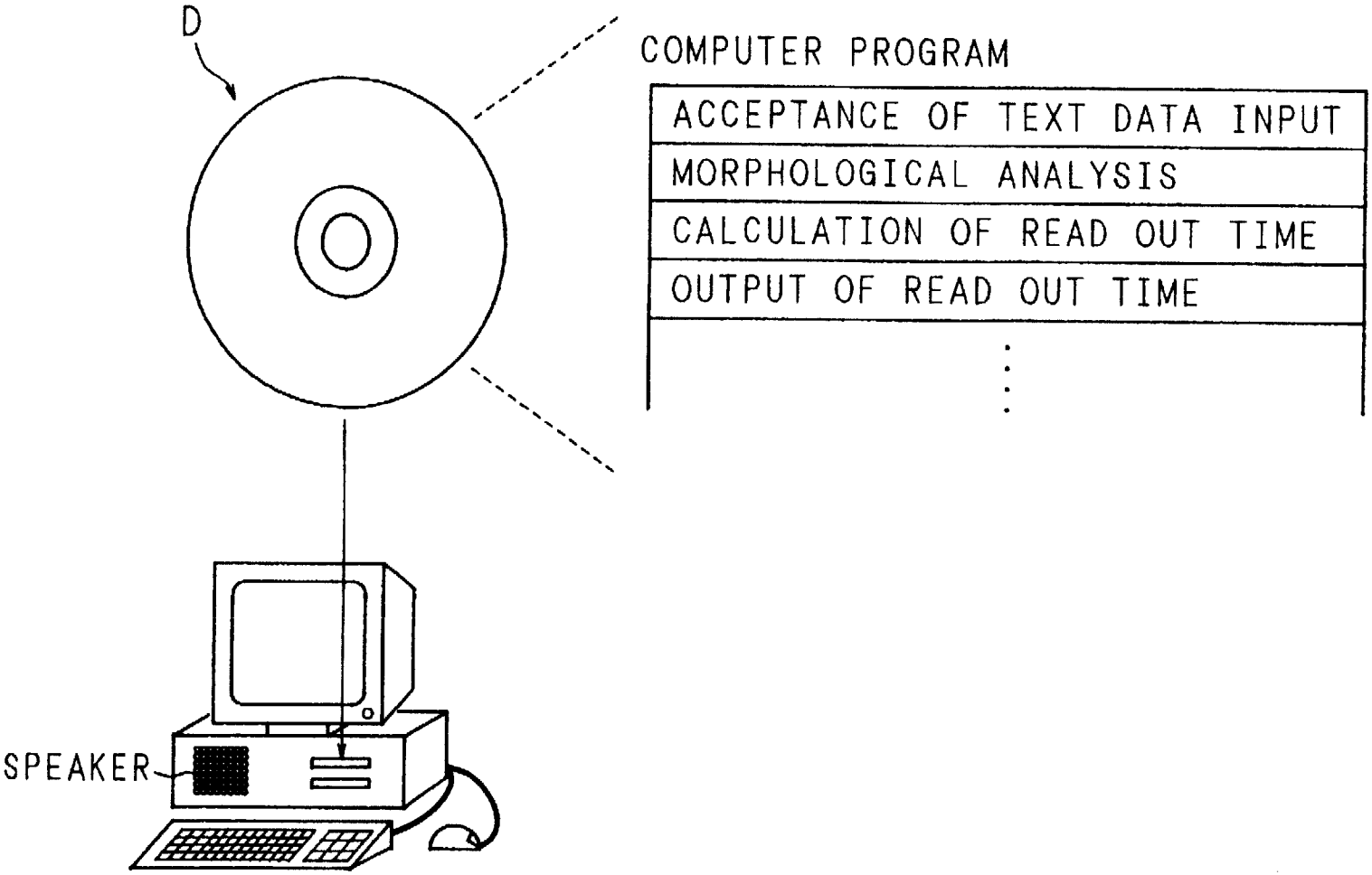
FIG. 12 is a conceptual diagram showing the recorded state of a medium of the invention on which recorded a computer program involving the procedure of FIG. 11 to calculate time to finish reading out a text.

A computer program of the above-mentioned procedure of calculating read out time of the the text may not only be written in a ROM of the read out time calculating apparatus having the construction as shown in FIG. 3, but may be written in a recording medium D such as a compact disk as shown in FIG. 12. When loading such recording medium D in a disk drive of a personal computer, the personal computer becomes able to calculate the read out time of the text.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A speech synthesis apparatus for reading out a text by synthesizing speech, comprising:

means for inputting text data;

means for setting a time to finish reading out the text;

means for morphologically analyzing the input text data;

means for calculating a time necessary to finish reading out the text data at a prescribed speed based on the morphological analysis result of the text data;

means for determining a read out speed so as to make the calculated read out time agree with the set read out time by comparing the calculated time to the set time;

a database which stores data for the speech synthesis;

means for synthesizing speech by using the data for the speech synthesis in the database at the read out speed determined by said means for determining; and means for outputting the synthesized speech.

2. A speech synthesis apparatus as set forth in claim 1, wherein said data for the speech synthesis includes unit waveform signals of the text data being divided into units suitable for the speech synthesis on the basis of a phonological analysis of the text data.

3. A speech synthesis apparatus as set forth in claim 1, wherein said database further stores data on a speech characteristic of a specified reader, and said speech synthesizing means comprises means for synthesizing speech on the basis of the data on the speech characteristic.

4. A speech synthesis apparatus as set forth in claim 3, wherein said data for the speech synthesis includes unit waveform signals of the text data being divided into units suitable for the speech synthesis on the basis of a phonological analysis of the text data.

5. A computer readable medium on which is recorded:

a database which stores data for speech synthesis; and a computer program which when implemented performs:

a first step for accepting an input of text data;

a second step for accepting setting of a time necessary to finish reading out the text data;

a third step for morphologically analyzing the input text data;

a fourth step for calculating a time necessary to finish reading out the text data at a prescribed speed based on the morphological analysis result of the text data;

a fifth step for determining a read out speed so as to make the calculated read out time with the set read out time by comparing the calculated time to the set time;

a sixth step for synthesizing speech on the basis of the text data, at the speed determined in the fifth step, by using the data in the database; and a seventh step for outputting the synthesized speech.

6. A medium as set forth in claim 5, wherein said data for the speech synthesis includes unit waveform signals of the text data being divided into units suitable for the speech synthesis on the basis of a phonological analysis of the text data.

7. A medium as set forth in claim 5, wherein said database further stores data on a speech characteristic of a specified reader, and the sixth step is the step for synthesizing speech on the basis of the data on the speech characteristic.

8. A medium as set forth in claim 7, wherein said data for the speech synthesis includes unit waveform signals of the text data being divided into units suitable for the speech synthesis on the basis of a phonological analysis of the text data.

9. An apparatus for calculating a time necessary for a reader to finish reading out a text, comprising:

means for inputting text data;

means for morphologically analyzing the input text data;

means for calculating a time necessary to finish reading out the text data at a prescribed speed based on the morphological analysis result of the text data;

means for inputting the reader's speech;

means for extracting a relative value of a read out speed of the reader to the prescribed speed, which stores speech data of a prescribed word or a sentence at the prescribed speed, on the basis of the input reader's speech of the prescribed word or the sentence;

means for adjusting the calculated read out time at the prescribed speed to a read out time of the text data by the reader; and means for outputting the adjusted read out time of the text data by the reader.

10. A computer readable medium on which is recorded:

speech data of the prescribed word or sentence at a prescribed speed; and a computer program which when implemented performs:

a first step for accepting an input of text data;

a second step for morphologically analyzing the input text data;

a third step for calculating a time necessary to finish reading out the text data at a prescribed speed on the basis of the morphological analysis result of the text data;

a fourth step for accepting an input of reader's speech;

a fifth step for extracting a relative value of a read out speed of the reader to the prescribed speed based on the input reader's speech of the prescribed word or the sentence;

a sixth step for adjusting the calculated read out time at the prescribed speed to a read out time of the text data by the reader; and a seventh step for outputting the adjusted read out time of the text data by the reader.

11. An apparatus for calculating a time necessary for a reader to finish reading out a text, comprising:

means for setting a read out speed;

means for inputting text data;

means for morphologically analyzing the input text data;

means for calculating a time necessary to finish reading out the text data at the set read out speed based on the morphological analysis result of the text data; and means for outputting the calculated read out time of the text data.

12. A computer readable medium on which is recorded a computer program which when implemented performs:

a first step for accepting setting a read out speed;

a second step for accepting an input of text data;

a third step for morphologically analyzing the input text data;

a fourth step for calculating a time necessary to finish reading out the text data at the set read out speed based on the morphological analysis result of the text data; and a fifth step for outputting the calculated read out time of the text data.

* * * * *